US010167064B2

(12) United States Patent
Lockwood

(10) Patent No.: US 10,167,064 B2
(45) Date of Patent: Jan. 1, 2019

(54) SIDE CUTAWAY SYSTEM AND METHOD FOR KAYAKS

(71) Applicant: John B. Lockwood, Port Townsend, WA (US)

(72) Inventor: John B. Lockwood, Port Townsend, WA (US)

( * ) Notice: Subject to any disclaimer, the term of this patent is extended or adjusted under 35 U.S.C. 154(b) by 0 days.

(21) Appl. No.: 15/680,145

(22) Filed: Aug. 17, 2017

(65) Prior Publication Data

US 2018/0127066 A1 May 10, 2018

Related U.S. Application Data

(60) Provisional application No. 62/379,492, filed on Aug. 25, 2016.

(51) Int. Cl.

| | |
|---|---|
| ***B63B 35/71*** | (2006.01) |
| *B63B 5/02* | (2006.01) |
| *B63B 5/24* | (2006.01) |

(52) U.S. Cl.

CPC ..... *B63B 35/71* (2013.01); *B63B 5/02* (2013.01); *B63B 5/24* (2013.01); *B63B 2005/242* (2013.01); *B63B 2241/02* (2013.01)

(58) Field of Classification Search

CPC .. B63B 7/00; B63B 7/08; B63B 35/71; B63B 41/00; B63B 43/12; B63B 19/00; B63B 35/00

USPC ..... 114/347

See application file for complete search history.

(56) References Cited

U.S. PATENT DOCUMENTS

| | | | |
|---|---|---|---|
| 1,649,311 | A | 11/1927 | Kaechele et al. |
| 1,792,140 | A | 2/1931 | Brock |
| 1,889,368 | A | 11/1932 | Messenger |
| 2,999,253 | A | 9/1961 | Lewis |
| D233,424 | S | 10/1974 | Lettmann |
| D234,397 | S | 2/1975 | Eriksen |
| 4,031,580 | A | 6/1977 | Neumann et al. |
| 4,229,850 | A | 10/1980 | Arcouette |
| D258,581 | S | 3/1981 | Abboud |
| 4,480,579 | A | 11/1984 | Masters |
| 4,597,348 | A | 7/1986 | Jonas |
| D358,573 | S | 5/1995 | Lockwood |
| D370,454 | S | 6/1996 | Lockwood |
| D397,668 | S | 9/1998 | Lincoln |
| D418,801 | S | 1/2000 | Lockwood |
| D418,802 | S | 1/2000 | Lockwood |
| D419,128 | S | 1/2000 | Lockwood |
| D425,852 | S | 5/2000 | Lockwood |
| D464,303 | S | 10/2002 | Lockwood |
| 6,779,477 | B2 | 8/2004 | Lockwood |

(Continued)

OTHER PUBLICATIONS

Country Ways, Inc., Kayak Kits, "Scandian Single", Oct. 11, 1979, 1 page.

(Continued)

*Primary Examiner* — Lars A Olson

(57) ABSTRACT

The present invention is method of reducing the longitudinal beam of a kayak in the area of a kayaker's paddle stroke by incorporating a cutaway section. The invention allows the paddle to be closer to the center of gravity of the kayak and thus produce more drive force and less wasted turning force. The paddler doesn't have to reach out so far to the side and therefore has a more comfortable and ergonomic stroke.

10 Claims, 3 Drawing Sheets

(56) References Cited

U.S. PATENT DOCUMENTS

| | | | | |
|---|---|---|---|---|
| 7,739,976 | B2 * | 6/2010 | Aubrey | B63B 35/71 114/347 |
| 7,946,242 | B2 * | 5/2011 | Aubrey | B63B 35/71 114/347 |
| D724,000 | S | 3/2015 | Lockwood | |

OTHER PUBLICATIONS

Pygmy Kayak Co., "Pygmy Kayaks" brochure, 1993, 3 pages.
U.S. National Museum, Printings: "Aleutian Kayak" Unalaska, 1894, p. 196; "Kayak From Russian Siberia", 1962, p. 197; "Norton Sound Kayak" Alaska, 1889, p. 198; Kotzebue Sound Kayak (Cape Krusenstem), Alaska, p. 201; "Point Barrow Kayak" Alaska, 1888, p. 201; "MacKenzie Delta Kayak", p. 201; "Northwestern Greenland Kayak", p. 210, "Southwestern Greenland Kayak", 1921, p. 210.

* cited by examiner

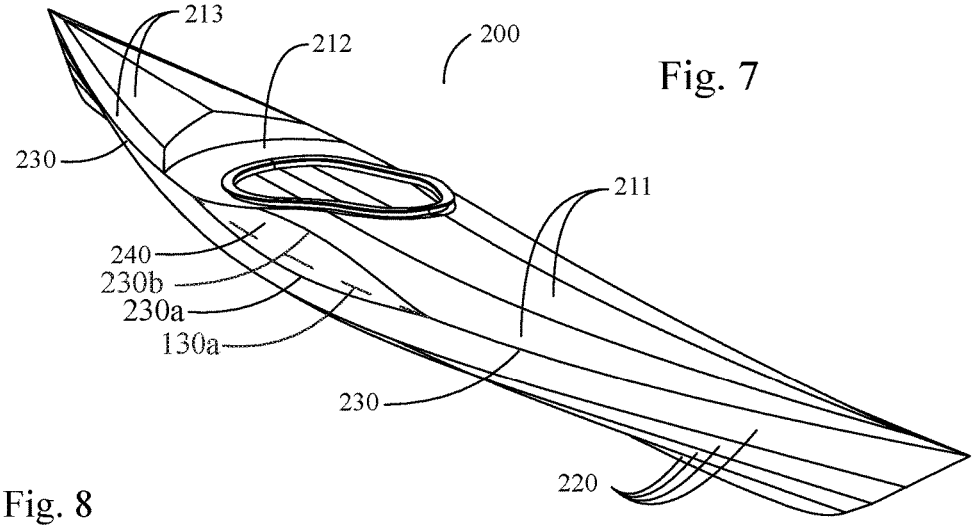
Fig. 7
Fig. 8
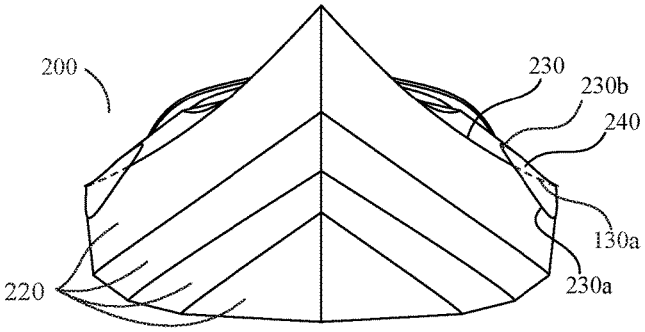
Fig. 9
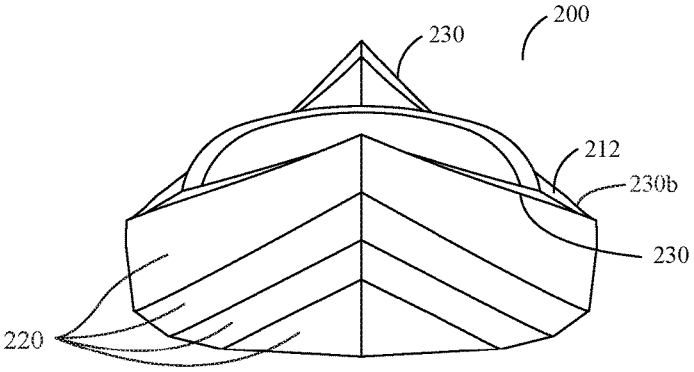

SIDE CUTAWAY SYSTEM AND METHOD FOR KAYAKS

BACKGROUND OF THE INVENTION

Related Applications

This application claims priority of U.S. Provisional Patent Application No. 62/379,492 which was filed on Aug. 25, 2016.

Field of the Invention

At least one of the example embodiments of the invention concerns a "stitch-and-glue" kayak made from wood and fiberglass panels. However, the concept, disclosed herein extends to kayaks made of any other materials such as plastic, fiberglass, Kevlar, carbon, wood, metal and fabric, etc., using various construction techniques including but not limited to hand laminated fiberglass, vacuum bagged fiberglass, rotomolded and blow-molded plastic, thermoformed sheets and processes sometimes referred to as twin-sheet processes, etc. The example embodiments of the invention concern a "sit in" type of kayak. However the concept disclosed herein extends to other types of kayaks such as, "sit on top" kayaks, collapsible kayaks and inflatable kayaks, etc.

Description of Related Art

In the present invention a portion of the hull and deck along both sides of a kayak is designed to make the kayak narrower in the area where the kayaker's paddle passes by the sides of the kayak. The beam longitudinal is the widest part of a kayak and the place where a kayaker is most likely to bang his knuckles on the side of a kayak while paddling. The disclosed invention makes the kayak narrower where the paddler's hands and paddle shaft pass by the kayak greatly improving the paddling ergonomics and efficiency of the kayaker's paddle stroke.

The present invention relates to a wide variety of kayak types and designs. The longitudinal beam of a boat is the transverse distance between the outer sides of the boat, i.e. the widest part of the boat at any given point running down its length. In many kayaks the widest part of the kayak is where the deck joins the hull and is commonly called the sheer line. In the example embodiments the sheer line is a sharp angle. However this invention extends to many other kayaks that have rounded sides where the beam longitudinal may be in an area where the side of the kayak is curved or completely flat.

In two of the embodiments depicted here the design started out as a 24 inch wide by 15 foot long kayak. The invented beam cutaway (referred hereafter as the "cutaway") narrowed the maximum sheer line width (aka maximum beam) from 24 inches to 21 inches yet the kayak retains the same initial stability of the larger 24 inch kayak. You get much closer, more efficient and ergonomic paddle stroke at the cost of a small loss of secondary stability. For many people initial stability is one of the most important features of a kayak. The disclosed invention will be useful to paddlers who use narrow bladed paddles, one example of which is a Greenland Paddle. The disclosed invention will also make Eskimo Rolling a kayak easier which is of value to many kayakers.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit its scope. Aspects of the invention will be described and explained with additional specificity and detail through the use of the accompanying drawings in which:

FIG. 7 is a perspective view of an example kayak with the present invention FIG. 8 is a front view of an example kayak with the present invention FIG. 9 is a rear view of an example kayak with the present invention

DETAILED DESCRIPTION OF THE INVENTION

As noted elsewhere herein, the example embodiments of the invention concern a "sit in" type of kayak. However the concept disclosed herein extends to other types of kayaks such as, "sit on top" kayaks, collapsible kayaks and inflatable kayaks, etc.

A. General Aspects of Some Example Embodiments

As noted elsewhere herein, the example embodiments of the invention concern wooden/fiberglass stitch-and-glue kayaks with a sharp well defined longitudinal beam at the sheer line where the deck meets the hull. However the concept disclosed herein extends to other types of kayaks in which the longitudinal beam is rounded or flattened. Furthermore the concept disclosed herein extends to other types of kayaks in which the longitudinal beam may not be located where the deck the deck meets the hull, for example the widest part of the kayak in some embodiments may occur on the deck above where the deck joins the hull or on the hull below where the deck joins the hull.

Furthermore the concept disclosed herein extends to other types of kayaks which are made of any other materials such as plastic, fiberglass, Kevlar, carbon, wood, metal and fabric, etc. It will also be appreciated that the kayak may be constructed using other materials having other suitable characteristics.

Furthermore the concept disclosed herein extends to other types of kayaks which are made using various construction techniques including but not limited to hand laminated fiberglass, vacuum bagged fiberglass, rotomolded and blow-molded plastic, thermoformed sheets and processes sometimes referred to as twin-sheet processes, etc. It will also be appreciated that characteristics.

B. Description of Some Example Embodiments Without the Disclosed Invention was Installed.

Figure 1:
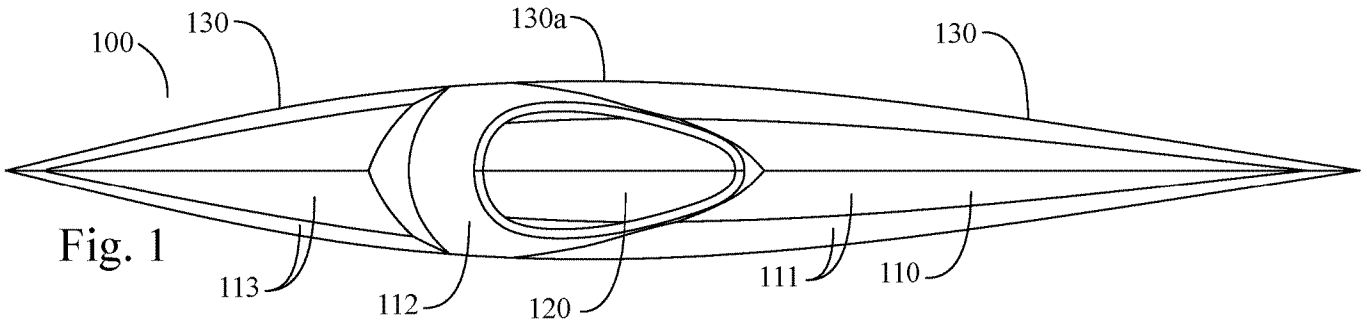
FIG. 1 is a top view of an example kayak without the present invention
Figure 2:
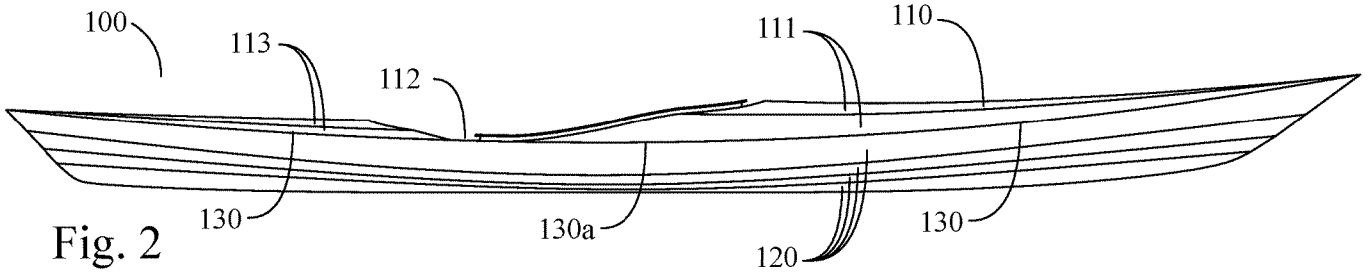
FIG. 2 is a profile view of an example kayak without the present invention

Turning now to FIGS. 1 and 2, details are provided concerning an example kayak 100 which does not have the disclosed invention. This example 100 takes the form of a stitch-and-glue kayak with a multi panel deck and hull. With regard first to FIGS. 1 and 2, the kayak 100 has a deck 110 that has an arched foredeck 111, a flat middeck 112 and an arched rear deck 113.

The kayak 100 has a sharp well defined longitudinal beam 130 at the sheer line where a deck meets the hull 120. The portion of the longitudinal beam 130*a* is where the paddler's hands and paddle shaft pass by the kayak. In this example kayak it starts forward of the cockpit where the kayaker's paddle passes downward past the longitudinal beam and extends aft to where the paddler's paddle stroke ends. The length of 130*a* will very on depending on the length of the paddle being used and the type of paddle stroke the kayaker takes. This is the area of a kayak where a paddler is most likely to bang his paddle and or his hand on the widest part of the kayak where the paddle and hand pass by the longitudinal beam 130*a*. This portion of the kayak 130*a* limits how close to the boats center of gravity the paddler can paddle. It is in this area that the disclosed invention changes the minimum-paddle-stroke-width of a kayak.

In the top view FIG. 1 of the example hull 100 is symmetric with the right side being the same as the left side. For clarity and brevity 111, 113, 130 and 130*a* are show only on one side but are the same on the other side.

C. Description of Some Example Embodiments With the Disclosed Invention.

Turning now to FIGS. 3-9, details are provided concerning an example kayak 200 which is the same as kayak 100 but with the invention 240 installed. Example kayak 200 takes the form of a stitch-and-glue kayak with a multi panel deck and hull. In this example embodiment the disclosed invention 240 is a stitch-and-glue wooden panel. 230*a* is the bottom edge of the side cutaway where it intersects with the hull. And 230*b* is the top edge of the side cutaway where it intersects with the deck. With regard to FIGS. 3-9, the kayak 200 has a deck 210 that has an arched foredeck 211, a flat middeck 212 and an arched rear deck 213. Other embodiments may have a flat deck throughout, a rounded deck throughout or any combination of fore, mid and aft deck shapes.

Example kayak 200 has a sharp well defined longitudinal beam 230 at the sheer line where the deck meets the hull 220. As already noted this invention have other embodiments may have rounded sides where the beam longitudinal 230 may be in an area where the side of the kayak is curved or completely flat. The scope of the invention is not limited to the shape, construction technique or materials of kayak deck 210, hull 220 or disclosed invention 240. Furthermore the disclosed invention 240 in other embodiments need not be a flat or a bent flat surface but may be of any shape that still diminishes the width of a kayak in the area of the kayaker's paddle stroke. Furthermore in other embodiments the disclosed invention 240 need not meet the kayak body at an angle but may join the body at a rounded, curved or other appropriate way.

Figure 3:
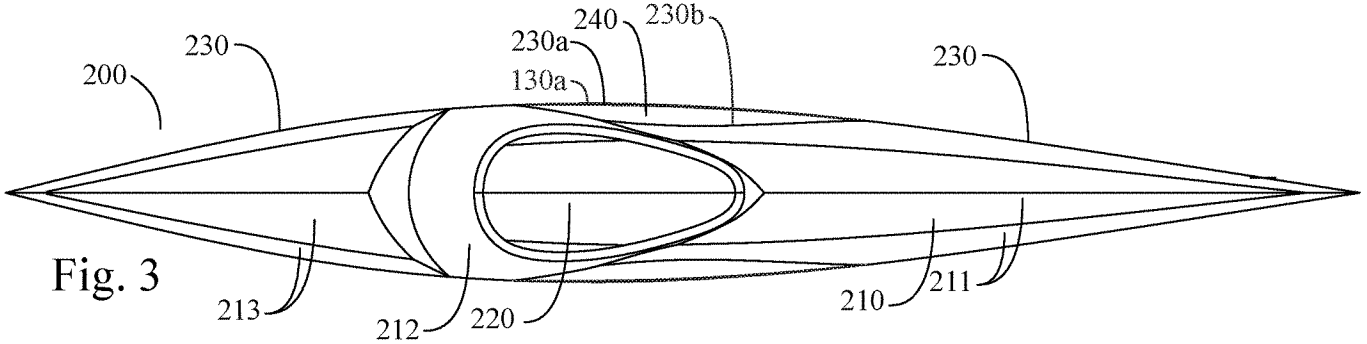
FIG. 3 is a top view of an example kayak with the present invention

In the top view FIG. 3 of the example hull 200 is symmetric with the right side being the same as the left side. For clarity and brevity 211, 213 and 230 are show only on one side but are the same on the other side.

Figure 4:
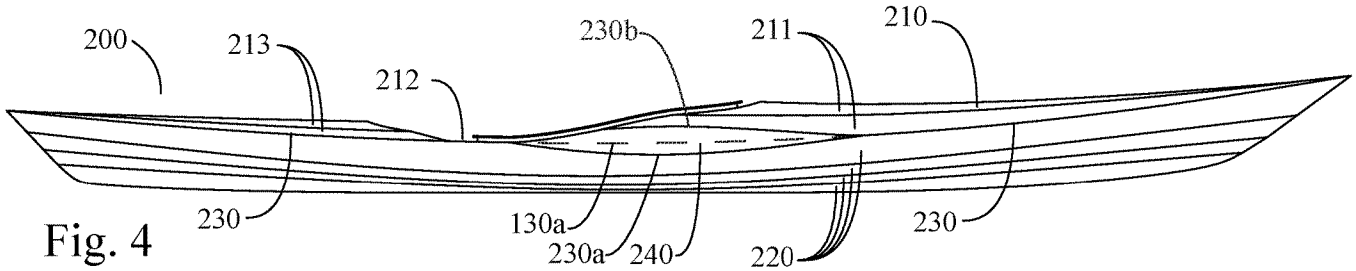
FIG. 4 is a profile view of an example kayak with the present invention

Referring now to the invention 240 shown in FIGS. 4 and 8, it can be seen that the cutaway lowers the height of the original longitudinal beam in the area of the paddle stroke area 130*a* in FIG. 4 to the bottom of the cutaway at 230*a*. In this example embodiment the invention narrows the kayak's width in the area of the kayaker's paddle stroke while maintaining a wider beam width at or near the waterline preserving initial stability. However, the concept disclosed herein may extend to other embodiments where the bottom edge of the invention is below or above the kayak's waterline.

Figure 5:
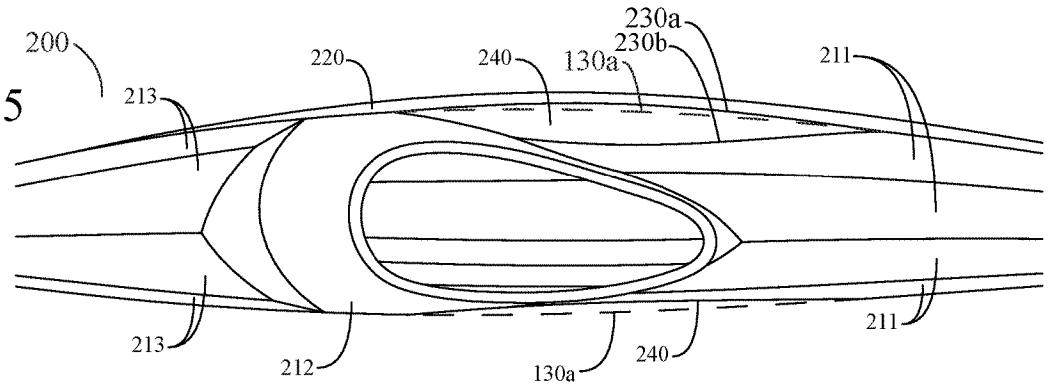
FIG. 5 is a longitudinally rotated view of an example kayak with the present invention
Figure 6:
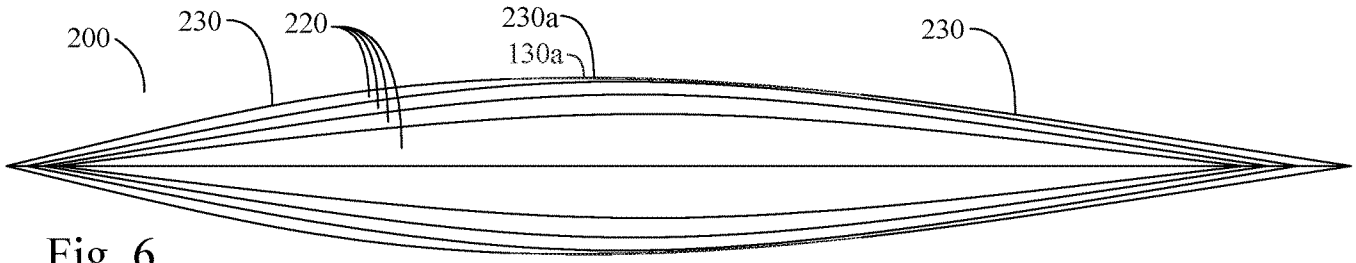
FIG. 6 is a bottom view of an example kayak with the present invention

Referring now to the invention 240 shown in FIG. 5, the figure is an enlarged view of the center of the kayak to show detail. The example kayak has been rotated longitudinally until the right side cutaway 240 is on edge and displays as just a line in this view. It can be seen that the cutaway 240 is substantially narrower than the longitudinal beam 130 of the original example kayak 100 shown in FIGS. 1 and 2. In this particular example kayak where a paddlers hand passes the old longitudinal beam 130*a*, the kayak 200 has is one-and-a-half inches narrower. Removing a significant amount of the original longitudinal beam width 130*a* in the paddle stroke area allows a paddler to make a significantly more efficient and more ergonomic stroke. It allows the paddle to be closer to the center of gravity of the kayak and thus produce more drive force and less wasted turning force. The paddler doesn't have to reach out so far to the side and therefore has a more comfortable and ergonomic stroke.

While the invention 240 is sometimes herein referred to as a "beam cutaway" or "cutaway" it should be appreciated that the invention is not intended primarily for cutting away the sides of existing kayaks. The invention is primarily, but not exclusively, intended to be incorporated in new or changed kayak designs.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A side cutaway system for a kayak comprising:

a deck and hull;

a side cutaway on both sides of the kayak in an area where a kayaker's knuckles and paddle shaft pass by the kayak, and a bow sheer line ends at the bow end of the side cutaway, and a stern sheer line ends at the stern end of the side cutaway, and a top edge of the side cutaway intersects with the deck, and a bottom edge of the side cutaway intersects with the hull, and the side cutaway creates a discontinuity in the shape of the kayak which allows the paddle shaft to pass closer to the center of the kayak.

2. A side cutaway system as recited in claim 1, is a stitch-and-glue kayak made out of plywood panels, and the side cutaway is a plywood panel, which can be a flat, curved or twisted panel.

3. A side cutaway system as recited in claim 1, is a kayak including the disclosed cutaway in which the longitudinal beams or sheer lines and the side cutaway edges are angled, rounded, curved or flat in cross section.

4. A side cutaway system as recited in claim 3, is a kayak made of plastic.

5. A side cutaway system as recited in claim 3, is a kayak made of fiberglass, carbon fiber, Aramid synthetic fibers, polyester fibers or other suitable material either as one or in combination which are impregnated with polyester resin, epoxy resin or other suitable resin.

6. A side cutaway system as recited in claim 3, is a kayak including the disclosed cutaway, and is a sit-on-top kayak made of any suitable materials.

7. A side cutaway system as recited in claim 3, is a kayak including the disclosed cutaway, and is an inflatable kayak made of any suitable materials.

8. A side cutaway system as recited in claim 3, is a kayak made of a skin of canvas, Aramid synthetic fibers, polyester fibers or other natural or synthetic fabric that has been coated, saturated or otherwise treated with rubber, a flexible polymer or other suitable material over an internal structure made of wood, aluminum tubing or other structural material.

9. A side cutaway system as recited in claim 8, is a skin-on-frame kayak.

10. A side cutaway system as recited in claim 8, is a collapsible kayak.

* * * * *